United States Patent [19]

Bullivant

[11] Patent Number: 5,070,672

[45] Date of Patent: Dec. 10, 1991

[54] SUPPORTS FOR BUILDING STRUCTURES

[75] Inventor: Roger A. Bullivant, Newton Solney, England

[73] Assignee: Roger Bullivant of Texas, Inc., Grand Prairie, Tex.

[21] Appl. No.: 8,484

[22] Filed: Jan. 29, 1987

[30] Foreign Application Priority Data

Jan. 30, 1986 [GB] United Kingdom ..... 8602254

[51] Int. Cl.[5] ..... E04B 1/00

[52] U.S. Cl. ..... 52/742; 52/169.9; 52/252; 405/149; 405/229

[58] Field of Search ..... 52/169.8, 169.9, 252, 52/263, 742, 744, 743, 294, 295, 299; 264/35, 34, 251; 405/149, 229

[56] References Cited

U.S. PATENT DOCUMENTS

| | | | |
|---|---|---|---|
| 794,971 | 7/1905 | Ericsson . | |
| 1,954,188 | 4/1934 | Thornley . | |
| 2,618,146 | 11/1952 | Ciarlini | 52/252 |
| 2,741,910 | 4/1956 | Thornley | 52/294 X |
| 3,243,927 | 4/1966 | Hilson | 52/169.9 |
| 3,425,175 | 2/1969 | Gerde . | |
| 3,464,215 | 9/1969 | Spanovich | 52/294 X |
| 3,867,805 | 2/1975 | Mikami et al. | 52/744 |
| 4,007,568 | 2/1977 | Soble | 52/294 |
| 4,018,055 | 4/1977 | LeClercq | 52/742 X |
| 4,258,514 | 3/1981 | St. Clair | 52/742 |
| 4,275,538 | 6/1981 | Bounds | 52/294 X |
| 4,365,451 | 12/1982 | Nelson | 52/742 |
| 4,409,764 | 10/1983 | Wilnau | 52/252 X |
| 4,485,598 | 12/1984 | Guardiani | 52/742 X |
| 4,494,694 | 1/1985 | Pitt et al. | 238/2 |
| 4,601,615 | 7/1986 | Cavalli | 52/742 |

FOREIGN PATENT DOCUMENTS

| | | | |
|---|---|---|---|
| 107746 | 6/1939 | Australia | 52/294 |
| 247835 | 11/1963 | Australia | 52/743 |
| 426705 | 5/1911 | France | 52/252 |
| 2316394 | 1/1977 | France | 52/743 |

OTHER PUBLICATIONS

Progressive Architecture, ©Feb. 1963, p. 79.

*Primary Examiner*—Henry E. Raduazo
*Attorney, Agent, or Firm*—Richards, Medlock & Andrews

[57] ABSTRACT

A method of forming a base for a building structure comprises forming a plurality of holes in the ground on which the structure is to be supported, each hole diverging upwardly and pouring a mould for a concrete support column formed in situ therein, the support columns supporting beam sections forming a ring beam on which the building structure can be built.

20 Claims, 1 Drawing Sheet

SUPPORTS FOR BUILDING STRUCTURES

TECHNICAL FIELD

The present invention concerns a method of providing a support for a building structure, especially but not exclusively a domestic dwelling.

BACKGROUND ART

Currently the provision of supports or foundations for relatively small buildings, for example houses, involves numerous different techniques each of which depends upon the environment in which the building has to be constructed. In certain instances, for example, deep wide trenches have to be dug so that shuttering can be erected in which reinforced concrete footings are formed; in other instances piles have to be driven; in other instances slab floors which may or may not be piled have to be laid; all prior to the actual house erection operation.

It is an object of the present invention to provide a method and apparatus for providing a support for a building which can be used irrespective of the environment in which the building has to be constructed.

DISCLOSURE OF THE INVENTION

According to the present invention there is provided a method of forming a base for a building structure comprising forming a ring beam for the structure by supporting a plurality of beam sections on upwardly diverging support columns which are formed from concrete poured in situ.

BRIEF DESCRIPTION OF THE DRAWINGS

An embodiment of the present invention will now be described by way of example only with reference to the accompanying drawings, in which.

DETAILED DESCRIPTION

The method and apparatus of the present invention involves a house building system incorporating a precast concrete floor assembly. An assembly of this nature comprises a plurality of spaced parallel beams each having outwardly projecting lower flanges on which are placed a plurality of precast concrete blocks to span the gap between beams whereby the top surface of the blocks is coincident with the top surface of the beams to provide a continuous floor. The beams are supported at their ends on ring beams which, in general terms, extend around the periphery of the house.

The method and apparatus of the present invention has as one of its objects the provision of a simple arrangement for providing and supporting a ring beam, which method can be used irrespective of the environment in which the house is being built.

Figure 2:
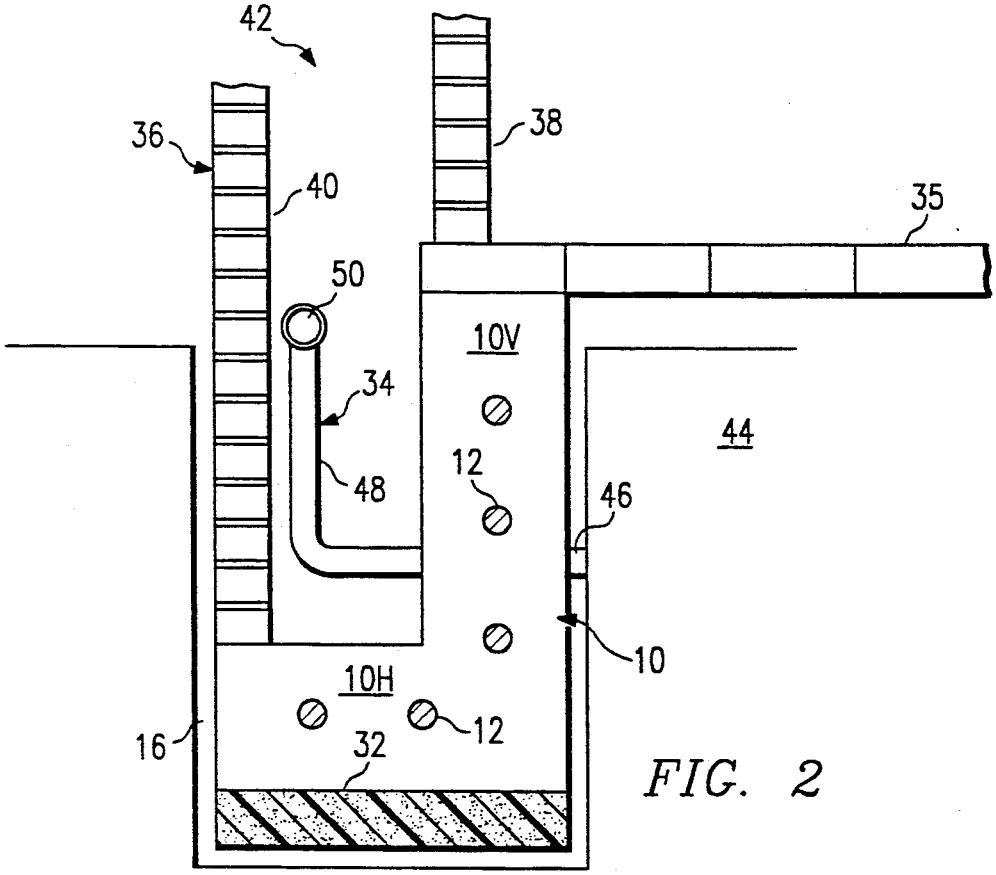
FIG. 2 shows a cross-sectional elevation of a support beam section.

The inital step of the method of the invention comprises designing to scale the location of the ring beam, its make-up and ground-engaging support columns on which the ends of beam sections making up the ring beam sections rest.

Where possible the ring beam sections 10 are of a constant length, conveniently 2½ m, which can be readily man-handled. The ring beam sections are pecast and have an L-shaped cross-section which incorporates reinforcing bars 12 (FIG. 2). Conveniently the reinforcing bars project beyond the end of each beam section so that, if necessary, the reinforcement can be joined to that of the next section and/or the support column 14.

After the building site has been initially prepared, i.e. by levelling, an operative marks out the site according to the pre-arranged plan by laying thereon rectangular and circular templates, the rectangular templates occupying positions to be taken up by beam sections 10, the circular templates occupying positions to be taken up by the heads of the support columns 14. After the laying out has been completed and suitable checks have been carried out, for example utilising a pre-arranged location and level peg, a more permanent record of the marking out is made by driving steel pegs into the ground at the centre of each support column 14.

The first working operation involves the use of a standard rotavator which has its blades set to a predetermined depth, for example 12". The rotavator is then moved over the line between two pegs to loosen the soil so that it can be readily removed by operatives following the rotavator, either manually or by a machine, to provide a trench 16 in a predetermined location and of a predetermined depth.

Figure 4:
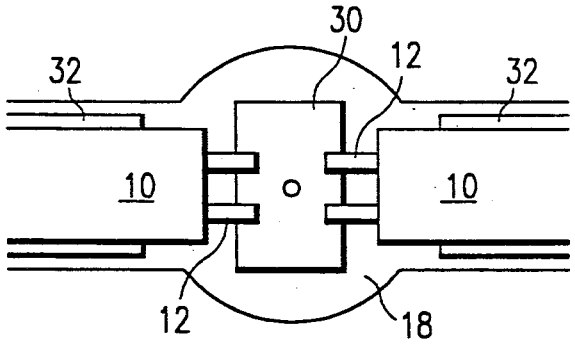
FIG. 4 is a plan of the junction of two beam sections.

The next operation is to prepare the ground in those areas marked by the steel peg for reception of the ground engaging support columns 14. In general terms, each ground column comprises one or more pile sections driven into an enlarged hole 18 pre-formed in the ground at the meeting of two beam sections (FIG. 4).

Special apparatus is provided for use in forming the pre-formed hole and driving the piles, the apparatus being of the type disclosed in our co-pending U.K. Patent Application No. 8505799.

The pile driving apparatus comprises essentially a vehicle carrying a pile driving assembly incorporating a large annular mass in the centre of which is located a ram which lifts the mass and allows it to fall onto an anvil which sits on top of a pile section or a casing to be described below. The apparatus includes also guide means for the anvil and the mass.

To provide a good base for the driving assembly to operate from the ground over which it moves can be temporarily covered by reinforced sheets. These may be arranged round the pegs in such a manner that they will provide a centre for the driving assembly.

Figure 1:
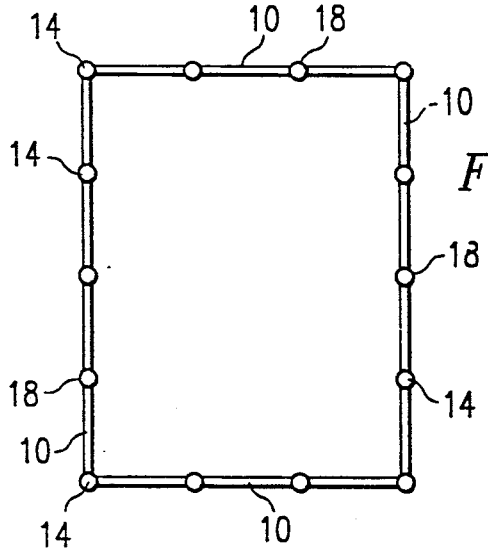
FIG. 1 shows a plan of a support assembly for a building.
Figure 3:
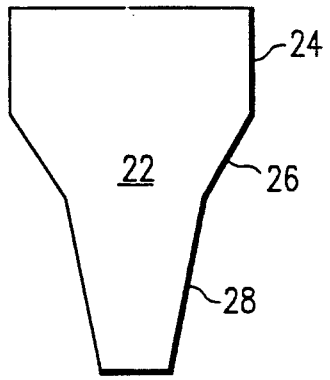
FIG. 3 is a side view of a casing used in the method of the invention.

In the first instance a casing 22 of the type shown diagrammatically in FIG. 3 is forced into the ground, centred on the centre of the previously driven steel peg, which is now removed. The casing is approximately 1 m long, has an upper diameter of 18", a first gradually inwardly and downwardly tapering section 24 of 8" length and thereafter a more sharply downwardly and inwardly tapering section 26 terminating in a support 28 for a square pre-cast concrete reinforced pile 30 which has either 6" or 8" sides.

A removable tip (not shown) is provided on the casing 22 which is fitted to the anvil of the pile driving assembly which, after careful positioning over the steel peg, is caused to operate to force the casing into the ground until its top is at ground level.

The anvil is then lifted off the casing 22 and a pile section 30 of a type disclosed in our U.K. Patent Application No. 8505799 located in the lower end of the casing at its base and in a guide on the underside of the anvil at its head and driven into the ground below the casing until pile driving is terminated with the top of the pile section located at a pre-arranged depth within the casing. In certain ground conditions more than one pile section may be called for and, if so, the sections are joined in the manner disclosed in our co-pending Application referred to above. Piles are driven until they are capable of supporting at least a 10 tonne load. If the casing tip is to be recovered the casing may be removed to allow removal of the tip before replacing the casing to provide the pile guide. Alternatively the first pile section can rest on the tip which is then driven down with the pile, serving as its tip. In a modified arrangement it is possible to remove the casing prior to the pile driving operation.

As soon as the pile 30 has been driven and the casing 22 removed, the hole left by the casing is filled (to a predetermined level) with concrete which is of a small enough quantity to be easily mixed on site, and before the concrete has set a beam section 10 is laid in the trench 16 leading to the hole with the end of the section protruding into the hole. The beam section 10, as stated above, is precast to strict dimensional tolerances and, to facilitate its correct positioning, a slab 32 of expanded polystyrene is first laid in the trench, the polystyrene being carefully positioned and levelled to pre-arranged values. As the polystyrene slab 32 is of light weight this positioning step is relatively easy and when the beam is manhandled onto the polystyrene slab, as the slab is at the correct level and location, the beam 10, as a result of its dimensional accuracy, will also occupy the desired location and level.

During the operation comprising filling the pe-formed hole with concrete and laying the beam the next pre-formed hole is being formed and the pile driven so that, effectively, a continuous beam laying operation can follow the hole and pile forming apparatus.

After two beam sections have been positioned a final layer of concrete is poured into the hole to bring the level of concrete to the desired design level which is normally coplanar with the beam tops. If necessary the concrete cast in the hole can include reinforcement to tie the beam sections to each other and/or to the pile and it is preferable that it includes also a cast in airway 34, the purpose of which will be described later.

After the concrete on the pile and at the end of the beam sections has set it is possible to lay the ends of the longitudinal beams (not shown) for the pre-cast concrete floor on the beam sections 10 and the set concrete in the holes to span the floor area of the house and subsequently fit concrete floor blocks 35 between the floor beams.

The beam sections 10, as described above, are of generally L-shaped configuration with the vertical limb 10V of the L innermost with respect to the house. Thus the horizontal limb 10H of the L projects outwardly and forms a base on which the outer brick wall 36 for the building can be laid. The inner brick wall 38 can be laid on the precast floor 35 after it has been laid.

The outer brick wall 36 incorporates air bricks 40 to provide ventilation of the cavity 42 between the brick walls and of the under-floor space 44. It will be realised that the cavity 42 is isolated from the space 44 below the floor as a result of the continuous nature of the ring beam and cast concrete assembly. Thus airways 34 are provided through the cast concrete assembly 18 as the concrete is being poured. The airways 34 conveniently comprise plastics pipe having a first horizontal section 46 intended to lead into the air space 44 below the floor and being connected at the end opposed to the open end with a vertical section 48 intended to project above the level of the cast concrete and terminating in a further horizontal section 50 whose axis runs perpendicularly to the axis of the lower horizontal section, the upper horizontal section 50 being provided to prevent the air passage being clogged by mortar falling into the cavity during the brick laying operation.

Conveniently at the end of each wall where it joins to a neighbouring wall the beam sections are mitered, the mitering operation being carried out either before the beams are supplied to side or on site by a pendulum diamond wheel cutter.

It will be realised that the method and apparatus of the present invention is applicable for any building irrespective of whether the ground is good, bad, subjected to heave, water-logged, etc. Perhaps the only skilled operation is the setting out of the original stencil and thereafter the method can be carried out virtually continuously by unskilled operatives who bring to the site with them all the material they require so that the process can continue without delay while delivery of ready-mixed concrete, for example, is awaited.

All the apparatus can be self-contained on one lorry which can also carry from site-to-site the fork-lift truck which, of course, is of considerable assistance not only in driving piles and forming holes but in mechanically handling ring beam sections, floor beams, floor blocks, etc.

Numerous modifications can be made without departing from the scope of the invention, for example alternative means can be provided for digging the trenches for the ring beam sections and for providing the pre-formed hole at the ring beam joints. In this latter case an hydraulic or pneumatic soil displacement mole could be fitted within the casing and allowed to descend into the ground carrying the casing down with it. The mole could also be used to pre-form an oversized hole in which a hollow upper pile casing could be fitted in ground subjected to heave. In another method of pre-forming the hole the casing could be forced into the ground by a suitable vibrating assembly supported by a crane mounted on the transport lorry.

In another modification where the building is being erected on soil having a firm nature, for example clay, the hole providing the pile cap may be formed by a tapered auger. Ground of this nature is often subjected to heave and consequently any pile extending downwardly from the pile cap should be isolated from the heaving ground so that heave does not alter the position of the pile. Thus the auger can have a substantially parallel sided extension from its tapered section such that during the augering operation a hole into which a pile section can be fitted is formed downwardly from the pile cap. This extension hole has a diameter greater than the maximum transverse dimension of the pile such that the pile can fit with clearance in the hole which is either lined with an additional casing or filled with a substance, for example polystyrene beads, which permits movement of the soil surrounding the pile over the pile surface.

In other conditions where the ground is particularly good the conical pile cap may provide sufficient support for the ring beam, that is no piles may be called for.

Where the building includes internal beams these can extend from the pre-formed holes so that they are supported on the pile cap formed by the poured concrete.

In buildings which are erected on non-level ground the footings or foundations are often stepped, that is they move from one level to another.

The method and apparatus of the present invention can readily cope with this by providing special conical casings 22 which form a step. Thus, in operation, a step in the foundation is formed at the location of one of the steel pegs driven in during the setting out operation and a stepped casing 22 is utilised at this point.

Whilst endeavouring in the foregoing specification to draw attention to those features of the invention believed to be of particular importance it should be understood that the Applicant claims protection in respect of any patentable feature or combination of features hereinbefore referred to whether or not particular emphasis has been placed thereon.

I claim:

1. A method of forming a foundation for a building structure on a ground surface comprising sequentially forming holes in the ground surface, filling said holes to predetermined levels to form support columns, before the concrete is set, interconnecting said support columns with previsouly poured support columns by positioning a beam with each end resting within the upper end of two of said concrete support columns, continuing to form said holes and interconnecting said holes with said beams until a complete ring foundation is formed by said beams on the ground surface, with said beams supported by said support columns, and allowing said concrete to set to form a unitary structure between said beam and support columns.

2. The method according to claim 1 further comprising:

laying templates on the ground on which the structure is to be erected at locations to be occupied by the ring beam and the tops of the support columns and marking the center of the support columns by positioning a marker thereat.

3. The method according to claim 2 wherein before removal of the templates, marking the position of the support columns and the beams by painting around the edges of the templates.

4. The method according to claim 1 further comprising:

supporting a floor slab on the completed ring beam and support column assembly by laying pre-formed reinforcement concrete floor beams across the ring beam and supporting pre-formed concrete blocks between the floor beams.

5. The method according to claim 1 in which said beams have an L-shaped cross-section with the limb of the L-shaped cross-section projecting outwardly.

6. The method according to claim 5 in which an outer brick wall is supported on the limb of said beams.

7. The method according to claim 6 in which an inner brick wall supported on the floor slab.

8. The method according to claim 7 further comprising:

forming an air passage in the top of the support column as the top of the support column is filled with concrete, such air passage leading from the interior of the foundation to the exterior.

9. A method of forming a foundation for a building structure on a ground surface comprising:

forming at least two pre-formed holes in the ground surface to define at least a portion of the formation to be formed, filling said holes to a predetermined level with concrete to form support columns in situ, before said concrete is set, interconnecting said support columns by positioning a beam with each end resting within the upper end of said support column, allowing said concrete to set to form a unitary structure between said beam and support columns, and continuing to add concrete to said holes after said beams have been positioned such that the concrete level in the support columns is coincident with the upper surface of the beams.

10. A method of forming a foundation for a building structure on a ground surface comprising:

forming at least two pre-formed holes in the ground surface to define at least a portion of the formation to be formed, filling said holes to a predetermined level with concrete to form support columns in situ, before said concrete is set, interconnecting said support columns by positioning a beam with each end resting within the upper end of said support column, allowing said concrete to set to form a unitary structure between said beam and support columns, laying said beam in a trench which is prepared to position the top of the beam at a predetermined elevation, and laying packing slabs of a lightweight material in the trench defined for said beam and deforming said lightweight material as needed to position the upper surface of said beam at a predetermined elevation.

11. A method of forming a foundation for a building structure on a ground surface comprising:

forming at least two pre-formed holes in the ground surface to define at least a portion of the formation to be formed, filling said holes to a predetermined level with concrete to form support columns in situ, before said concrete is set, interconnecting said support columns by positioning a beam with each end resting within the upper end of said support column, allowing said concrete to set to form a unitary structure between said beam and support columns, placing reinforcement material in the support column, and interlinking said reinforcement material with reinforcement material in the beam to thereby tie said beam to the support column.

12. A method of forming a foundation for a building structure on a ground surface comprising:

forming at least two pre-formed holes in the ground surface to define at least a portion of the formation to be formed, filling said holes to a predetermined level with concrete to form support columns in situ, before said concrete is set, interconnecting said support columns by positioning a beam with each end resting within the upper end of said support column, allowing said concrete to set to form a unitary structure between said beam and support columns, and forming the pre-formed holes by driving a conical steel casing into the ground surface to define the desired shape for such hole.

13. The method according to claim 12 in which the steel casing is driven with a removable tip thereon.

14. The method according to claim 12 in which the casing is removed after the hole has been formed and prior to filling such hole with concrete.

15. A method of forming a foundation for a building structure on a ground surface comprising:

forming at least two pre-formed holes in the ground surface to define at least a portion of the formation to be formed, filling said holes to a predetermined level with concrete to form support columns in situ, before said concrete is set, interconnecting said support columns by positioning a beam with each end resting within the upper end of said support column, allowing said concrete to set to form a unitary structure between said beam and support columns, and forming the pre-formed holes by operating a conical auger to form a conical hole.

16. The method according to claim 15 in which the conical auger has a parallel-sided extension to provide a hole for a pile extending downwardly from the support column.

17. A method of forming a foundation for a building structure on a ground surface comprising:

forming at least two pre-formed holes in the ground surface to define at least a portion of the formation to be formed, filling said holes to a predetermined level with concrete to form support columns in situ, before said concrete is set, interconnecting said support columns by positioning a beam with each end resting within the upper end of said support column, allowing said concrete to set to form a unitary structure between said beam and support columns, and forming a pile from the bottom of the pre-formed hole by driving a pile through the bottom of such hole prior to filling such hole with concrete.

18. The method according to claim 17 in which the pile is guided by the lower opening through the casing during the pile driving operation.

19. The method according to claim 18 in which the pile is driven in a plurality of sections.

20. The method according to claim 17 further comprising driving such pile until the top thereof is at a level between the top and bottom support column hole.

* * * * *